United States Patent [19]

Anderson et al.

[11] Patent Number: 5,029,617

[45] Date of Patent: Jul. 9, 1991

[54] REED WITH REMOVABLE DENTS

[76] Inventors: Barbara C. Anderson, P.O. Box 1314, Cornelian Bay, Calif. 95711; Joseph Jurman, 22891 Willard Ave., El Toro, Calif. 92630

[21] Appl. No.: 521,923

[22] Filed: May 18, 1990

Related U.S. Application Data

[63] Continuation of Ser. No. 375,454, Jul. 5, 1989, abandoned.

[51] Int. Cl.[5] ..... D03D 49/62

[52] U.S. Cl. ..... 139/192

[58] Field of Search ..... 139/192, 190, 191, 188 R, 139/29

[56] References Cited

U.S. PATENT DOCUMENTS

| | | | |
|---|---|---|---|
| 1,214,948 | 2/1917 | Ojerholm | 139/192 |
| 4,844,131 | 7/1989 | Anderson et al. | 139/192 |

FOREIGN PATENT DOCUMENTS

| | | | |
|---|---|---|---|
| 49011 | 10/1889 | Fed. Rep. of Germany | 139/192 |
| 234835 | 5/1910 | Fed. Rep. of Germany | 139/192 |
| 618291 | 2/1949 | United Kingdom | 139/192 |

*Primary Examiner*—Andrew M. Falik

*Attorney, Agent, or Firm*—Plante, Struass, Vanderburgh and Connors

[57] ABSTRACT

A loom reed comprises a reed frame of a generally rectangular configuration in which the longitudinal members are provided with passages for receiving and maintaining a plurality of dents in spaced relationship. The dents are individually removably received in the passages formed in the longitudinal members and dent spacing is varied by removing or adding dents at desired locations along the longitudinal members of the reed frame. Lateral end members complete the loom frame assembly. These are desirably permanently affixed to the ends of the longitudinal members to provide a high strength frame capable of meeting the demands of commercial weaving operations.

4 Claims, 1 Drawing Sheet

REED WITH REMOVABLE DENTS

This application is a continuation of application Ser. No. 07/375,454, filed Jul. 5, 1989, now abandoned.

FIELD OF THE INVENTION

This invention relates to reeds for looms and more particularly to reeds in which the reed dents are individually removed and added without disassembly of the reed and where dent spacing is adjusted by the removal or addition of one or more dents.

BACKGROUND OF THE INVENTION

Conventionally loom reeds comprise a frame having generally wire form members or dents extending between longitudinal members of the frame. Conventionally, the dents are attached at their ends to the longitudinal frame members in a permanent or semi-permanent manner and the spacing between dents is fixed for the particular reed. If it is desired to change or vary the dent spacing, it is necessary to disassemble the entire reed which is highly inconvenient, time consuming and difficult. Accordingly, many weavers maintain an inventory of reeds in which the dent spacing varies from reed to reed for different size yarns and to accommodate textiles of different tightness. Occasionally, it becomes necessary to replace a dent due to wear and tear. In such a case a conventional reed must be disassembled in order to remove and replace the worn or broken dent.

More recently, fashions in textiles have changed and textiles having beads and other similar decorative articles woven into the fabric of the textile are in demand as well as textiles having different size yarn in the same fabric. To weave such textiles it is necessary that the reed be provided with non-uniform dent spacing. That is to say one or more large dent spaces are distributed on the reed to accommodate the large warp yarn or yarns carrying beads or other similar items to be woven into the textile fabric. In such cases it is advantageous to be able to conveniently change the dent spacings as required without having to utilize a different reed and to disturb the loom setup as would be required to change a conventional reed.

Reeds designed for the replacement of worn or broken dents are known in the prior art, such as for example: U.S. Pat. No. 9,544,512 issued Apr. 12, 1910 to J. G. Gourdeau; German Patent 4,9011, Shepinsky, issued Apr. 28, 1889; British Patent 618,291, Hartley et al, accepted Feb. 18, 1949; British Patent 3,734, Carothers, published 1884. Reeds of this design, however, are inconvenient to use even though the dents are removable from the frame member because the dents are not individually removable and it is necessary to disassemble a substantial portion of the reed in order to remove or replace dents or to move dents in order to vary the dent spacing.

In U.S. Pat. Application Ser. No. 07/173,820 filed Mar. 28, 1988, Anderson et al, U.S. Pat. No. 4,844,131 there is disclosed an improved reed having dents which are individually removable. The device described therein overcomes the disadvantages of the aforementioned conventional reed designs. However, reeds constructed in accordance with this application require the use of individual spacer members between the individual dents to maintain the dents in position and provide the desired dent spacing. The dents and spacers are clamped together on the transverse members of the frame by the clamping action of removable end members which are carried by the transverse members of the reed frame and which complete the reed frame assembly.

SUMMARY OF THE INVENTION

The present invention relates to an improved reed in which the dents can be individually removed and replaced conveniently and without the necessity of disassembling the reed. In addition, the improved reed of the present invention eliminates the necessity for, and the inconvenience of, individual spacing members. Moreover, since the end connectors are not required for applying compressive force to maintain the dents in position on the transverse members, the reed frame can be made more rigid and stronger, as is desireable for commercial weaving operations and reed constructed in accordance with the invention are better suited for commercial manufacturing operations.

The improved reed of the present invention comprises a reed frame of a generally rectangular configuration in which the longitudinal members are provided with means for receiving and maintaining a plurality of dents spaced relationship. The dents are removably received in the longitudinal members and dent spacing is varied by removing or adding dents at desired locations along the longitudinal members of the reed frame. Lateral end members complete the loom frame assembly. Preferably these are permanently affixed to the ends of the longitudinal members to provide a high strength frame capable of meeting the demands of commercial weaving operations.

In a preferred embodiment means for locking and securing the dents to the longitudinal members is provided on at least one longitudinal member. The locking means is operable between a locked position wherein the dents are secured in the frame member and an unlocked position where the dents are free to be individually removed from or added to the frame.

The invention will be more fully understood from the following detailed description taken in conjunction with the following drawings.

DESCRIPTION OF THE INVENTION

Figure 1:
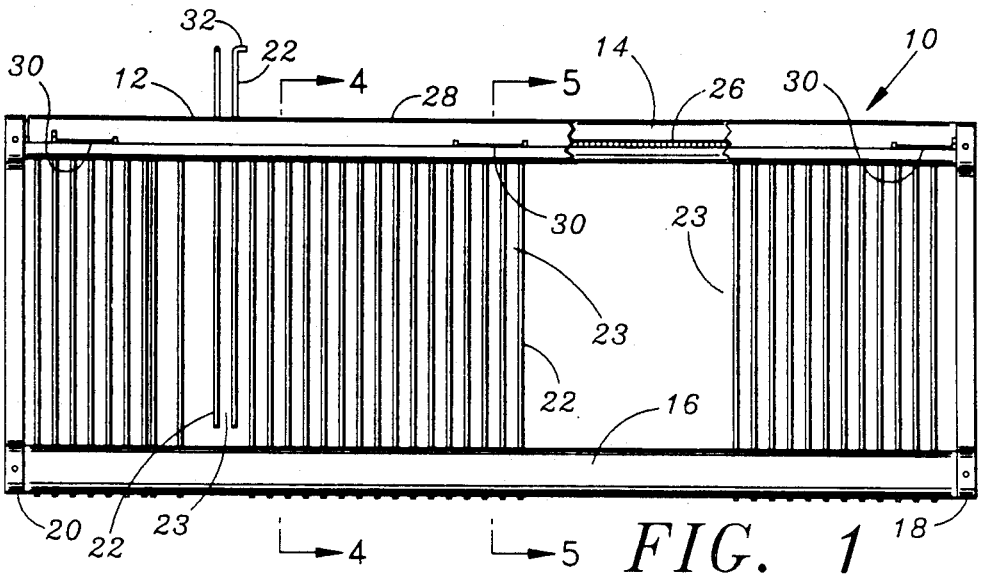
FIG. 1 is a front elevation, partially broken away, of a reed constructed in accordance with the present invention showing a variety of dent spacings and further illustrating several of the dents partially removed from the reed frame.

As illustrated in the figures, the reed of the present invention, shown generally as 10, comprises a frame 12 consisting of a first longitudinal member 14 and a second longitudinal member 16 and lateral connectors 18 and 20 which complete the frame assembly. A plurality of dents 22 extend between the first longitudinal member 14 and the second longitudinal member 16. The dents 22 may be conventional wire or flattened wire bodies. The dents 22 are maintained in spaced relationship with adjacent dents and the spaces 23 (dent spaces) between the dents 22 define passages for warp yarns and the like. It is well known in the art that the dent spaces 23 can be varied to affect the tightness of the weave of the fabric and also to accommodate different size yarns and beads or other decorative objects to be woven into the fabric. The longitudinal members may be solid or preferably tubular for ease in manufacture and weight and cost reduction.

During the weaving operation, the loom reed 10 is subjected to a substantial amount of vibration, sudden movement and the like and accordingly the reed frame 12 must be strong enough to withstand the rigors of the weaving process. By the same token, the dents 22 themselves may break or become deformed during the weaving process and thus replacement of one or more of the dents 22 may be required. As a consequence it is highly desirable to provide the capability of removing individual dents 22 for the purpose of repair or replacement and/or to vary the dent spaces 23 across the reed, such as would be required in weaving yarns of different size or varying the tightness of the weave or the like without detracting from the strength of the reed frame.

Figure 3:
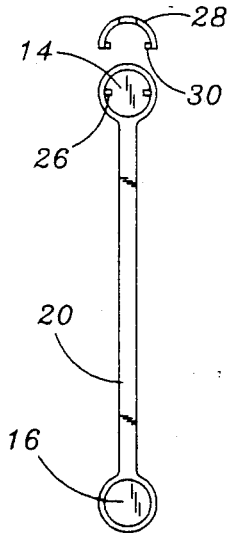
FIG. 3 is a partially exploded side elevation of the reed of FIG. 1 showing an end elevation of a locking means.
Figure 4:
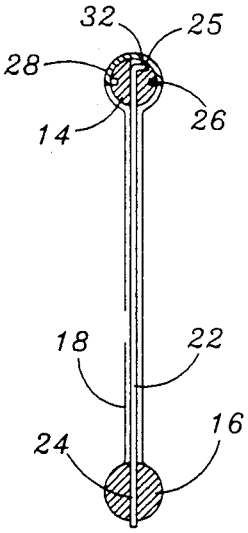
FIG. 4 is a sectional view taken along line 4—4 of FIG. 1.
Figure 5:
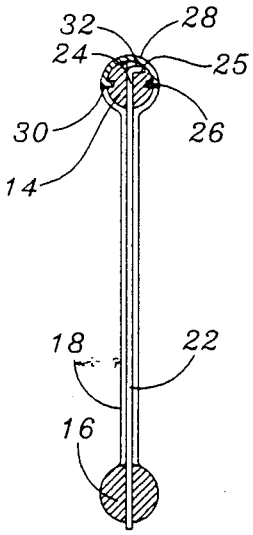
FIG. 5 is a sectional view taken along line 5—5 of FIG. 1.
Figure 2:
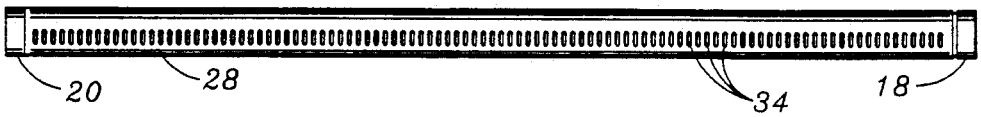
FIG. 2 is a plan view of the upper lateral member of the reed of FIG. 1.

As more clearly illustrated in FIGS. 1-5, a plurality of closely spaced individual passages 24 are provided in the first longitudinal member 14 and the second longitudinal member 16 for receiving the upper and lower portions of the dents 22. As illustrated, the passages 24 extend through the longitudinal members 14 and 16 essentially normal to the longitudinal axis of the longitudinal members and open at the upper and lower surfaces thereof. The passages 24, and the respective openings thereof, are in alignment when the longitudinal members 14 and 16 are assembled in the reed frame 12. The spacing between each of the openings 24 in the members 14 and 16 is preferably equivalent to the minimum desirable dent spacing for the reed 10. Normally, the minimum size of the dent spaces 23 will be on the order of 0.1 inches and thus the passages 24 will be spaced apart a like distance. However, it will be understood that the minimum spacing between the passages 24 is not critical and may be larger or smaller as desired depending upon the design of the reed 10. The dents 22 are removably positioned in the frame member the passages 24 in the longitudinal members 14 and 16. The upper end of each of the dents 22 is formed so as to define a normally extending projection 32 which serves as a shoulder to prevent the upper end of the dent 22 from passing through a passage 24 in the longitudinal member 14. In the embodiment shown in FIG. 1, the length of each dent 22 is such that the lower ends of the dents 22 extend through the lower longitudinal member 16 and serve to aid in raising a dent so that the upper end can be grasped for removing the dent from the frame 12. However, in those circumstances where it is desired not to have the lower ends of the dents 22 extending below the lower frame member 16, the passages 24 in the lower member 16 can be blind and open only at the upper surface of the member 16 to receive and support the lower ends of the dents 22. The length of each of the dents 22 can be reduced accordingly so that their upper ends are essentially coterminous with the upper surface of the longitudinal member 14 when the dents 23 are positioned in the frame 12. In such an embodiment, the upper ends of the dents 22 can be straight as they are supported in the frame 12 at their lower ends by the blind passages 24 in the lower member 16.

In the embodiments described above, although the dents 22 are not locked in the frame 12, the reed 10 is fully functional. However, unless the reed 10 is carefully handled while being mounted on the loom or while it is otherwise being handled, one or more of the dents 22 can be accidentally dislodged from its passage 23 in the frame 12 and may fall out of the frame 12. It is therefore preferred to provide locking means on the frame 12 to secure the dents 22 so to prevent any accidental dislodgement and to insure that the dents 22 retain their relative positions in the frame 12 regardless of the orientation of the reed 10 or the manner in which it is handled.

One embodiment of locking means is illustrated in the Figures. A locking slide 28 is movably carried by the upper longitudinal member 14 which is provided with a pair of opposed channels 26 located along the outer surface of the longitudinal member 14 approximately 90 degrees from the openings of the passages 24. The channels 26 extend substantially the length of the member 14 and define a path for the travel of the locking slide 28. Opposite edge portions 30 of the locking slide 28 are downwardly inwardly turned and are received in the longitudinally extending channels 26. In this fashion the locking slide 28 is retained over the upper portion of the first longitudinal member 14 in spaced relation thereto and the locking slide 28 is thus free to move in either direction parallel to the axis of the first longitudinal member 14. The travel of the slide 23 is limited at each end of the frame 10 by the upper ends of the lateral connectors 18 and 20 where they are joined to the member 14. In the alternative the travel of the slide 23 can be limited by a suitable lug or the like which defines a shoulder to stop slide travel. The locking slide 28 is provided with a plurality of elongated apertures 34 which are spaced apart to correspond with the openings 24 in the upper surface of the first longitudinal member 14 when the slide is in the unlocked position. The apertures 34, as illustrated, are elongated to permit the extending portions 32 of the upper ends of the dents 22 to pass when the projections are aligned with the apertures. In addition, channels 25 on the surface of the first longitudinal member 14 extend from the opening of the passages 23 for receiving the dent projections 32 so that they do not interfere with the travel of the slide 28 when the dents 22 are in the frame 12.

It will be understood that the apertures need not be so formed when utilizing the embodiment of the invention employing dents 22 with straight upper ends as described above.

In the unlocked (or unblocked passage) mode the locking slide 28 is positioned with each aperture 34 in alignment with an opening of a corresponding passage 24 in the longitudinal member 14 and the dents 22 can be individually inserted into and removed from the frame 12. In the locked (or blocked passage) position the locking slide 28 is moved on the longitudinal member 14 so that the apertures 34 and the openings of the passages 24 are out of alignment and the slide 28 covers the openings 24. The dents 22 are thus retained in their respective openings 24 in the member 14 and are secured in the reed frame 12.

With the reed frame 10 constructed in accordance with the invention, the minimum dent spaces 23 are fixed by the spacing between the passages 24. The dent spaces 23 are increased simply by removing individual dents 22 until one or more dent spaces of the desired size are achieved. The necessity for spacing means, such as spacing members, to achieve the desired pattern of dent spaces is eliminated. The frame members can be joined, such as by welding the members, to obtain a high strength assembly since disassembly of any part of the frame to remove or add dents is not required. While a particular embodiment of locking means has been described, it will be understood that various other systems for securing the dents 22 in the frame 12 may be employed, it being important only that the locking means function to secure the dents 22 in their respective passages 23.

As will be understood by those skilled in the art, various arrangements other than those described in detail in the specification will occur to those persons skilled in the art which arrangements lie within the spirit and scope of the invention. It is therefor to be understood that the invention is to be limited only by the claims appended hereto.

We claim:

1. An improved reed comprising;

a. a reed frame assembly consisting of a first and second longitudinal member, said longitudinal members defining upper and lower surfaces, and a lateral member securely affixed at each corresponding end of said first and said second longitudinal members a complete said frame assembly;

b. said first longitudinal member having a plurality of spaced apart, through-running passages extending normal to the longitudinal axis thereof and communicating through openings with said upper and lower surface thereof;

c. said second longitudinal member including a plurality of passages corresponding to and aligned with said through-running passages of said first longitudinal member, said passages communicating with at least the upper surface of said second longitudinal member through openings which are aligned with said corresponding openings on the lower surface of said first longitudinal member;

d. a plurality of spaced apart dents extending between said first and said second longitudinal members, said dents being removably received in said corresponding aligned passages in said longitudinal members, said dents being removable from said frame assembly while said longitudinal members and said lateral members are fully assembled, the spacing between said dents being determined by the spacing between said passages in which said dents are removably received;

whereby said dents are individually removable and dent space is varied by removing or adding said dents at desired locations along said longitudinal members of the reed frame without disassembling said reed frame.

2. The loom reed of claim 1 further including locking means carried by said first longitudinal member for securing said dents in said frame assembly and being operable to release said dents for removal of one or more of said dents from said frame assembly without disassembling said reed.

3. The loom reed of claim 1 wherein said locking means consists of a locking slide axially movably carried by said first longitudinal members, said locking slide having a plurality of apertures corresponding to said through running passages in said first longitudinal member, said locking slide having downwardly inwardly turned opposite edge portions which are received in opposed axially extending channels formed on said first longitudinal member to define a travel path for said locking slide whereby said locking slide is axially movable between a first position with each said aperture in alignment with an opening of a corresponding passage in said first longitudinal member and a second position in which said apertures are out of alignment with said opening of a corresponding passage to cover the openings of said passages so that dents located therein are secured in said frame.

4. The loom reed of claim 1 wherein one end of said dents extends essentially normal to the axis of said dent to define a projection to prevent said dents from passing through said through running passages in said first longitudinal member and to support said dents therein.

* * * * *